United States Patent [19]

Yokomori

[11] 4,431,014

[45] Feb. 14, 1984

[54] COIN SORTING MACHINE

[75] Inventor: Shinji Yokomori, Matsumoto, Japan

[73] Assignee: Fuji Electric Co., Ltd., Tokyo, Japan

[21] Appl. No.: 344,547

[22] Filed: Feb. 1, 1982

[30] Foreign Application Priority Data

Feb. 10, 1981 [JP] Japan ..... 56-17464
Feb. 17, 1981 [JP] Japan ..... 56-20905

[51] Int. Cl.[3] ..... G07D 5/08
[52] U.S. Cl. ..... 133/3 R; 194/100 A
[58] Field of Search ..... 194/99, 100 A, 100 R, 194/97; 133/3 R

[56] References Cited

U.S. PATENT DOCUMENTS 4,206,775 6/1980 Tanaka ..... 133/3 R
4,228,811 10/1980 Tanaka et al. ..... 133/3 R
4,257,435 3/1981 Tanaka et al. ..... 133/3 R
4,275,806 6/1981 Tanaka et al. ..... 194/100 A

*Primary Examiner*—Stanley H. Tollberg
*Attorney, Agent, or Firm*—Price, Heneveld, Huizenga & Cooper

[57] ABSTRACT

The specification discloses a coin-sorting device capable of distinguishing between an acceptable specie and an unacceptable slug. The device includes an impedance coil, positioned adjacent the coin passage and incorporated into a bridge circuit, and a decision unit reponsive to the bridge circuit for detecting the passage of a coin and determining whether the coin is a specie or a slug. The signal received from the bridge circuit is compared by a checkup circuit with two reference values to improve the reliability of the device.

3 Claims, 38 Drawing Figures

COIN SORTING MACHINE

BACKGROUND OF THE INVENTION

The present invention relates to electronic coin sorting machines.

Typically, a coin sorting machine includes a decision unit to determine whether a coin is an acceptable specie or an unacceptable slug and a selection unit to sort the species and slugs into separate coin passages. The decision unit includes a coin sensor, such as an inductance coil so that the impedance of the coil changes when a coin passes the sensor. The decision unit further includes circuitry to convert the change in impedance into a change in voltage and frequency to determine whether the coin is a specie or a slug.

FIG. 1 shows a conventional coin sorting machine including coin sensor, or impedance coil, 1 of the decision unit positioned at the side of gradient coin rail, or passage, 2 of the selection unit. A coin introduced through coin inlet 3 passes coin sensor 1 as the coin runs on rail 2. Upon exiting rail 2, a coin passes either into slug passage 4 or specie passage 5 as controlled by coin sensor 1 and gate lever 6. Gate lever 6 is driven by a solenoid (not shown) operating on command from coin sensor 1 to selectively provide a route to slug passage 4 for slugs, upon receiving a slug signal, or a route to specie passage 5 for species.

FIG. 2 shows a signal detection circuit for the selection unit of the coin sorting machine. Coin sensor 1 is incorporated into bridge circuit 7 together with resistor $r_0$, variable inductor $L_1$ and variable resistor $R_1$. Oscillator 8 is connected across bridge circuit 7. Variable inductor $L_1$ and variable resistor $R_1$ are adjusted so that bridge circuit 7 is balanced, or establishes an equilibrium, by a change in the impedance of coil 1 only when a specie passes coin sensor 1. Rectifying/smoothing circuit 9 includes differential amplifier 10, rectifiers 11A and 11B and filter condenser 12, and provides rectification and smoothing of output wave form $V_B$ from bridge circuit 7. Voltage divider 13, including resistors 13A and 13B, provides reference voltage $V_r$ at junction 14 to comparator 15. Output $V_B$ from bridge circuit 7 is rectified and smoothed through rectifying/smoothing circuit 9 to produce DC output $V_S$, which is inputted to comparator 15 to be compared with reference voltage $V_r$ inputted to the comparator 15 from voltage divider 13. The output of comparator 15 is fed into decision circuit 16 which determines whether the coin is a specie or a slug. Circuit 16 includes a flip-flop, a gate and a timer as disclosed, for example, in Japanese Patent Application No. 52-66971 (corresponding to U.S. Pat. No. 4,275,806, entitled COIN SORTING MACHINE, and issued June 30, 1981 to Tanaka et al). Comparator 15 outputs a signal, obtained as the result of comparing reference voltage $V_r$ with output voltage $V_S$ from rectifying/smoothing circuit 9, to decision circuit 16, which makes a decision on whether or not the coin is genuine according to said output signal.

When a specie passes coin sensor 1 in the detection unit, an equilibrium point is established only at one point in the waveform of output $V_B$ from the bridge circuit 7. Consequently, the waveform of output voltage $V_S$ from circuit 9 forms a trough which is lower than reference voltage $V_r$, only once as shown in FIG. 3(A); and one pulse is sent, as shown in FIG. 3(B), to decision circuit 16. The coin is determined to be a specie in such case. If a slug produces too slow a change in the impedance of coil 1, for example because of a variance in material, size, or weight, an equilibrium point is not established in output waveform $V_B$ from bridge circuit 7. Consequently, a trough lower than reference voltage $V_r$ does not appear in the waveform of output $V_S$, as shown in FIG. 4(A), and no signal is sent to decision circuit 16, as shown in FIG. 4(B). If a slug produces too fast a change in the impedance of coil 1, two equilibrium points appear in the waveform of output $V_B$ from the bridge circuit 7. Consequently, the waveform of output $V_S$ from circuit 9 forms a W-shaped trough going lower than reference voltage $V_r$ two or more times, as shown in FIG. 5(A), and two or more pulses are sent, as shown in FIG. 5(B), to detector circuit 16.

Therefore, when no pulse is outputted from comparator 15 to decision circuit 16, as shown in FIG. 4(B), and when two pulses are outputted, as shown in FIG. 5(B), decision circuit 16 determines that the coin is a slug and sends a slug signal to the selection unit to route the slug to slug passage 4.

The coin sorting machine as thus far described is generally well-known to those having ordinary skill in the art. However, in conventional coin sorting machines, a slug can produce a W-shaped waveform $V_S$, as shown in FIGS. 6(A) and 7(A), wherein only one of the two troughs A and B goes below reference voltage $V_r$. In such a case, only one pulse is inputted to decision circuit 16, which may lead to an erroneous determination that a slug is a specie. Such erroneous determinations seriously reduce the reliability of the coin sorting machine.

It is an object of the present invention to provide an improved coin sorting machine, eliminating the above-mentioned shortcomings and preventing slugs from being erroneously detected as species.

SUMMARY OF THE INVENTION

A bridge-circuit, coin-sorting machine is provided wherein the duration of the pulse outputted from the comparator is compared with two different time periods by two counters driven by a clock generator. A pulse is sent from either of the counters to a decision circuit only when the duration of the pulse from the comparator is longer than the time period of that counter. A deposited coin is determined to be a specie only when both counters each produce only a single pulse. A slug will never be determined to be a specie as is often the case with prior coin sorting machines. Thus, the coin detecting precision of the present invention is improved over known devices.

In an alternative embodiment, the bridge-circuit, coin-selecting machine comprises two comparators comparing the bridge circuit output with two different reference voltages. The deposited coin is determined to be a specie only when only one pulse is received from each comparator.

DESCRIPTION OF THE PREFERRED EMBODIMENT

Figure 8:
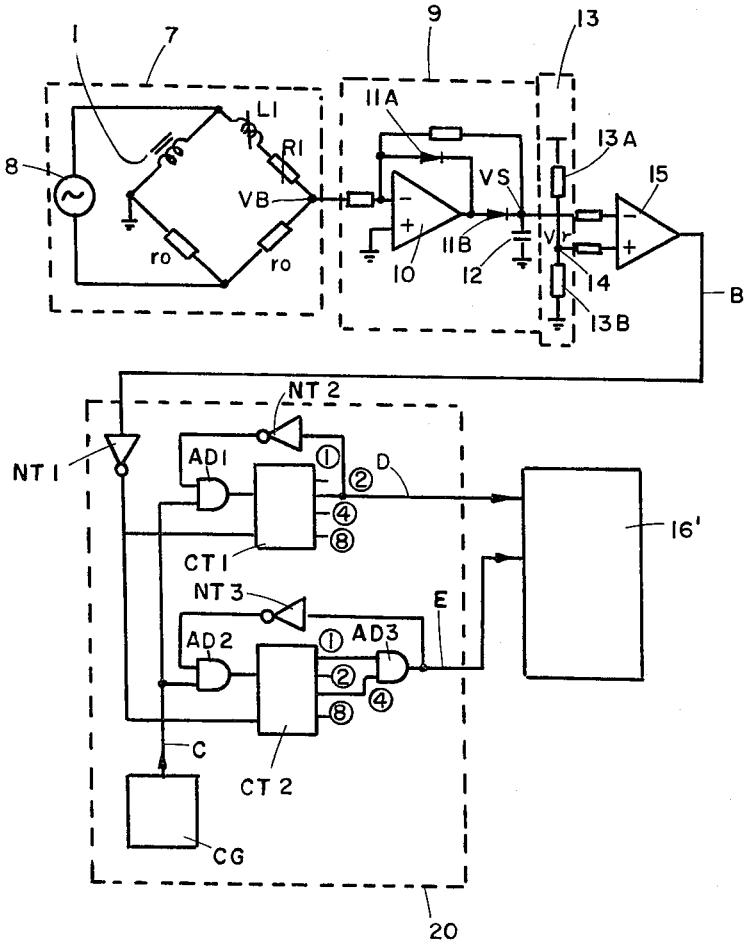
FIG. 8 is a circuit diagram showing the signal detection circuit of the decision unit of a coin sorting machine constructed in accordance with a preferred embodiment of the invention.

FIG. 8 represents one preferred embodiment of the decision unit circuit, or transferring circuit, of the present invention, including checkup circuit 20 interconnected between comparator 15 and decision circuit, or sorting output circuit, 16'. Bridge circuit 7, rectifying/smoothing circuit 9, voltage divider 13 and comparator 15 are similar to those shown in FIG. 2 and described above. Checkup circuit 20 includes two binary counters CT1 and CT2, inverters NT1, NT2 and NT3, AND circuits AD1, AD2 and AD3 and clock generator CG. Clock generator CG generates a clock pulse C at a relatively high frequency, for example 1000 Hz. Clock pulse C is then supplied to the clock input terminal of the first counter CT1 through AND circuit AD1 and of the second counter CT2 through AND circuit AD2. Further, output B of comparator 15 is supplied to each reset input terminal of binary counters CT1 and CT2. "2" output D of first counter CT1 is supplied to one input terminal of decision circuit 16' and also to AND circuit AD1 through inverter NT2. "1" and "4" outputs of second counter CT2 are supplied to AND circuit AD3. Output E of AND circuit AD3 is supplied to the other output terminal of decision circuit 16' and also to AND circuit AD2 through inverter NT3.

Output B from comparator 15 will be extracted by first counter CT1 after two clock pulses C from clock generator CG. Output B will be extracted by second counter CT2 after five clock pulses C from clock generator CG. That is to say that after a pulse on output B has reset first counter CT1, and after two clock pulses C have thereafter been inputted into the clock input terminal of first counter CT1, binary "1" is outputted on "2" output D of first counter CT1. Consequently, the output of inverter NT2 becomes binary "0", disabling AND circuit AD1 so that "2" output D remains binary "1". Similarly, after a pulse on output B has reset second counter CT2, and five clock pulses C have been thereafter inputted into the clock input terminal of second counter CT2, binary "1" is outputted on both the "1" and "4" outputs of second counter CT2, and binary "1" is outputted on output E of AND circuit AD3. Consequently, the output of inverter NT3 becomes binary "0", disabling AND circuit AD2 so that output E remains binary "1". Counters CT1 and CT2 are reset when the pulse on output B terminates.

Figure 1:
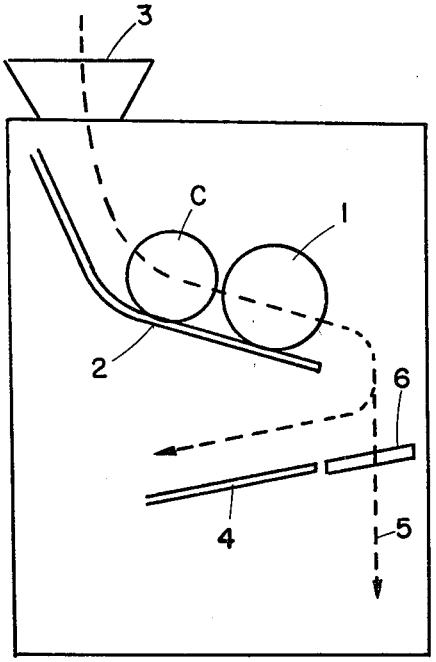
FIG 1 PRIOR ART
FIG. 1 shows a selection unit of a conventional coin sorting machine.
Figure 2:
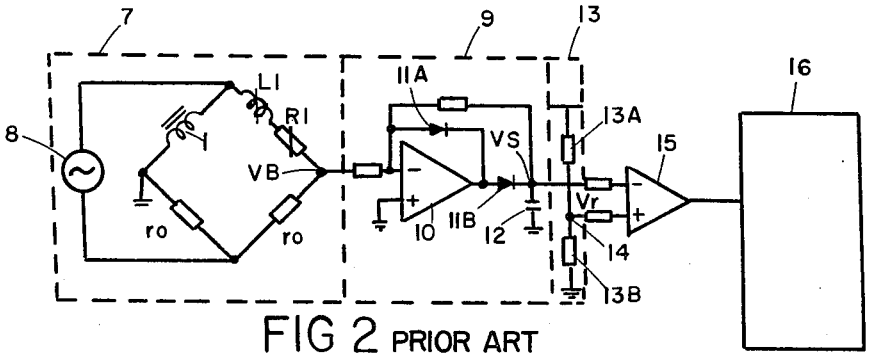
FIG 2 PRIOR ART
FIG. 2 is a circuit diagram showing the signal detection circuit of the decision unit of a conventional coin sorting machine.
Figure 3:
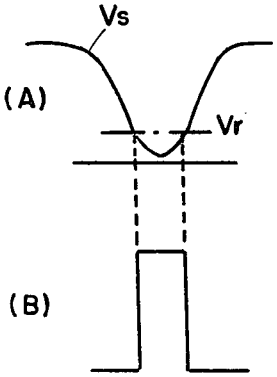
FIG 3 PRIOR ART
FIGS. 3(A) and 3(B) are waveform diagrams showing the outputs of the rectifying/smoothing circuit and the comparator in the detection circuit shown in FIG. 2 in the case of a specie.

Decision circuit, or sorting output circuit, 16' includes two circuits each similar to decision circuit 16 illustrated in FIG. 2 for counters CT1 and CT2. Circuits 16' further includes an AND circuit and a monostable multivibrator to detect when outputs D and E of counters CT1 and CT2 are both binary "1" once for a single coin, (as will be explained below) indicating that the coin is a specie.

Figure 9:
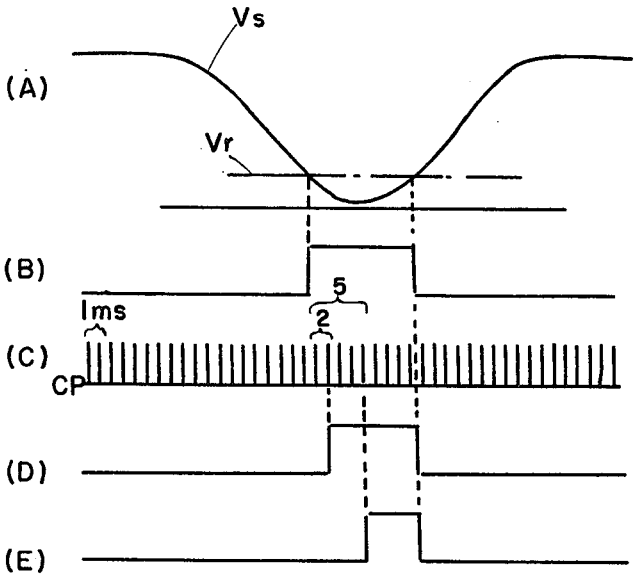
FIGS. 9(A), 9(B), 9(C), 9(D) and 9(E) are waveform diagrams showing the outputs from the rectifying/smoothing circuit, the comparator, the clock generator, the first counter and the second counter of the detection circuit shown in FIG. 8 in the case of a specie.

Checkup circuit 20 will now be described in operation with a coin deposited in the coin sorting machine. When a specie is deposited in the coin sorter, bridge circuit 7 is balanced. With such a specie, one trough appears in the waveform of output $V_S$, as shown in FIG. 9(A), from rectifying/smoothing circuit 9. Specie output B is one pulse, as shown in FIG. 9(B), and is fed into checkup circuit 20. Reference voltage $V_r$ is selected so that the width of one specie pulse, or output duration, is greater than a predetermined value, e.g. 5 msec. FIG. 9(C) shows clock pulses C, which are generated by clock generator CG at a predetermined period for example 1 msec at 1000 Hz. The output of inverter NT1 becomes binary "0" when the signal from comparator 15 is binary "1", thereby starting counters CT1 and CT2. First counter CT1 counts clock pulses C coming from clock generator CG and outputs binary "1" to decision circuit 16', as shown in FIG. 9(D), upon counting a predetermined small number of pulses, e.g. two. When the signal from comparator 15 returns to binary "0", the output of inverter NT1 becomes binary "1", thereby resetting first counter CT1 and specifically "2" output D to binary "0". The signal from comparator 15 is also sent to second counter CT2 simultaneously with first counter CT1. When second counter CT2 counts a predetermined number of clock pulses C (larger than that counted by counter CT1), e.g. five, it outputs binary "1" to decision circuit 16'. When the pulse on output B terminates, the output of inverter NT1 goes to binary "0" so that output E also goes to binary "0". Counter CT2 produces a single pulse at output E as shown in FIG. 9(E), to decision circuit 16'. The described parameters have been selected for a specie producing a pulse on output B of greater than 5 msec duration. Of course, other parameters may be selected for other species.

Decision circuit 16' will determine that the deposited coin is a specie only upon receiving one pulse each from counters CT1 and CT2.

Figure 10:
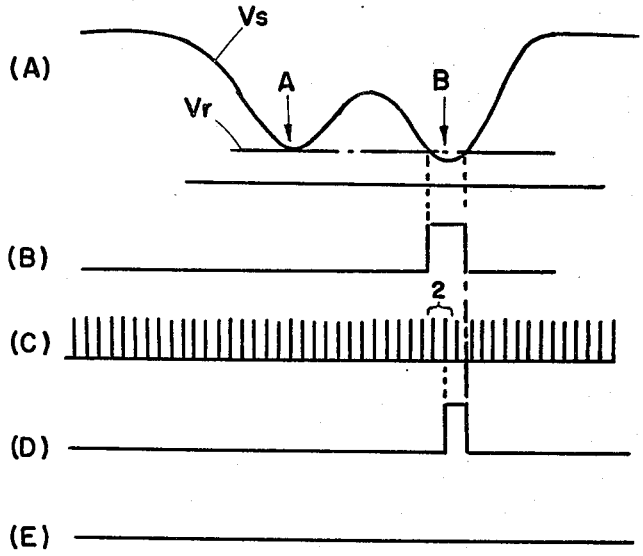
FIGS. 10(A), 10(B), 10(C), 10(D) and 10(E) are waveform diagrams showing the outputs of the rectifying/smoothing circuit, the comparator, the clock generator, the first counter, and the second counter of the detection circuit shown in FIG. 8 in the case of the fourth slug.

Next, the case where a slug is deposited, as shown in FIGS. 7(A) and 7(B) will be described. As shown in FIG. 10(A), the waveform of output $V_S$ in such a case includes two troughs A and B. The difference in voltage between troughs A and B is extremely minute. Therefore, the duration of the pulse coming out of comparator 15 corresponding to trough B, as shown in FIGS. 10(B) and 10(C), is less than 2 msec but not greater than 5 msec. Accordingly, first counter CT1 outputs one pulse, as shown in FIG. 10(D), and second counter CT2 does not output any pulse, as shown in FIG. 10(E). In this case where only first counter CT1 outputs only one pulse and second counter CT2 does not output any pulse, decision circuit 16' determines that the deposited coin is a slug.

Figure 4:
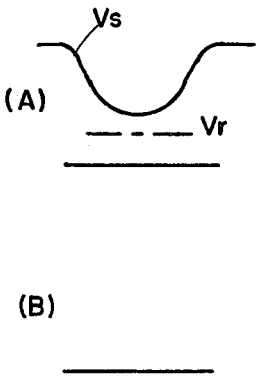
FIG 4 PRIOR ART
FIGS. 4(A) and 4(B) are waveform diagrams showing the outputs of the rectifying/smoothing circuit and the comparator in the case of a first slug.
Figure 5:
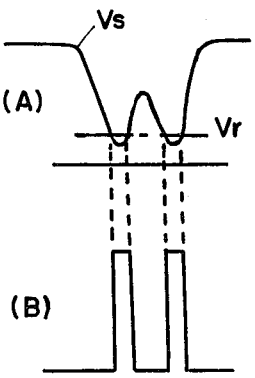
FIG 5 PRIOR ART
FIGS. 5(A) and 5(B) are waveform diagrams showing the outputs of the rectifying/smoothing circuit and the comparator in the case of a second slug.

In the case of a slug producing output $V_S$ of rectifying/smoothing circuit 9 and output B from comparator 15 as shown in FIGS. 4(A) and 4(B), no pulse will appear from either output D or E of counters CT1 and CT2. In the case of a slug producing outputs $V_S$ and B as shown in FIGS. 5(A) and 5(B), two pulses will appear on output D from first counter CT1, and no pulse will appear on output E from second counter CT2. In any case wherein other than a single pulse appears on either of outputs D and E from counters CT1 and CT2, decision circuit 16' determines that the deposited coin is a slug.

Figure 11:
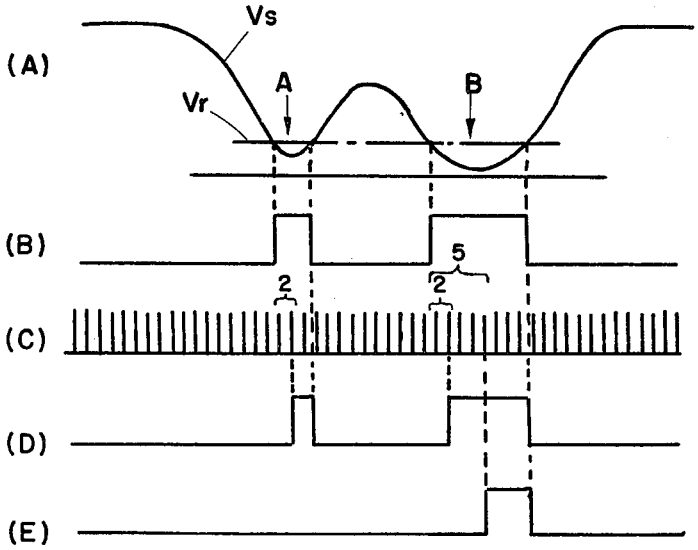
FIGS. 11(A), 11(B), 11(C), 11(D) and 11(E) are waveform diagrams showing the outputs of the rectifying/smoothing circuit, the comparator, the clock generator, the first counter, and the second counter of the detection circuit shown in FIG. 8 in the case of the fifth slug.

Counters CT1 and CT2, producing outputs D and E, respectively, are both required to enable decision circuit 16' to accurately detect a slug producing a waveform output $V_S$ as shown in FIG. 11(A). When such a slug is deposited into the machine, second counter CT2 produces a single pulse on output E, as shown in FIG. 11(E). However, second counter CT2 produces two pulses on output D as shown in FIG. 11(D) for such a slug. Consequently, the condition that only one pulse be received by decision circuit 16' from each of outputs D and E for a single coin is not satisfied, so that decision circuit 16' indicates that the coin is a slug.

Alternative Embodiment

Figure 12:
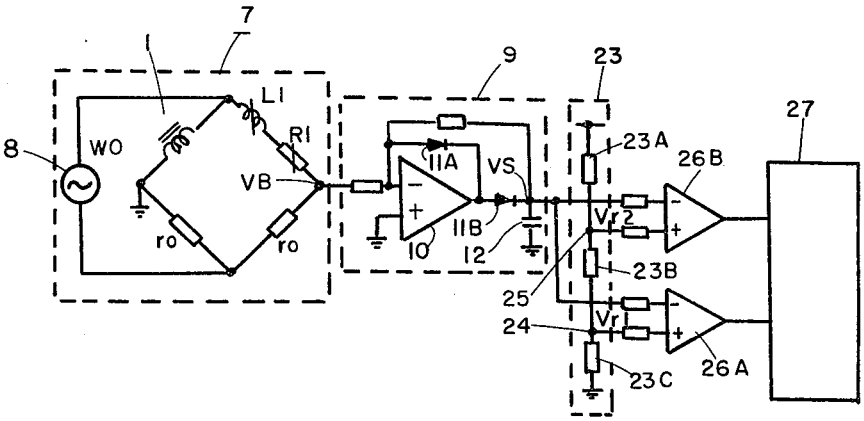
FIG. 12 is a circuit diagram showing the detection circuit of an alternative embodiment of the decision unit.
Figure 13:
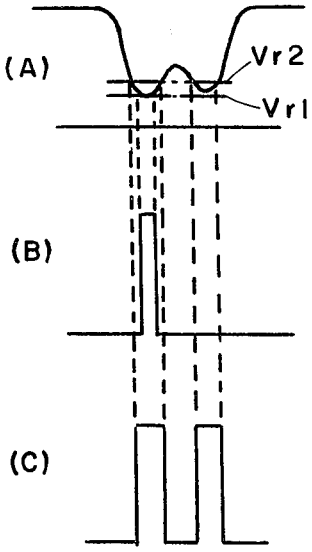
FIGS. 13(A), 13(B) and 13(C) are waveform diagrams of the outputs of the rectifying/smoothing circuit and the first and second comparators of the detection circuit shown in FIG. 12 in the case of the third slug.
Figure 14:
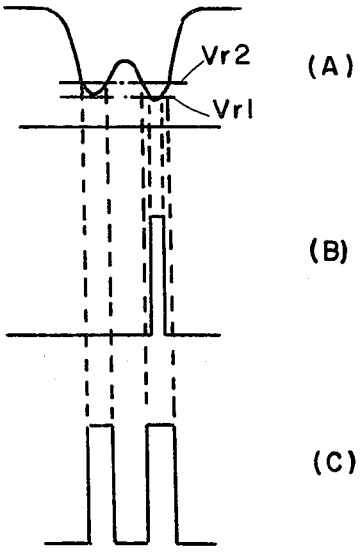
FIGS. 14(A), 14(B) and 14(C) are waveform diagrams showing the outputs of the rectifying/smoothing circuit and the first and second comparators of the detection circuit shown in FIG. 12 in the case of the fourth slug.
Figure 15:
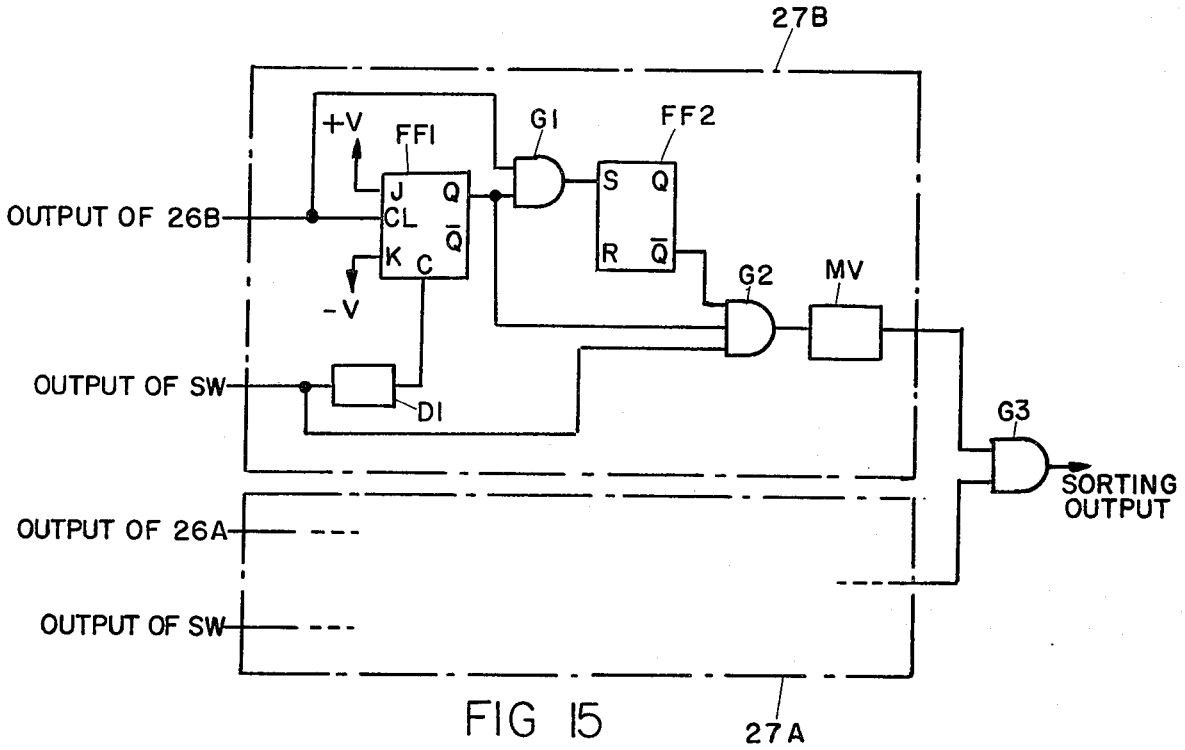
FIG. 15 is a circuit diagram showing the decision circuit of the alternative decision unit shown in FIG. 12.
Figure 16:
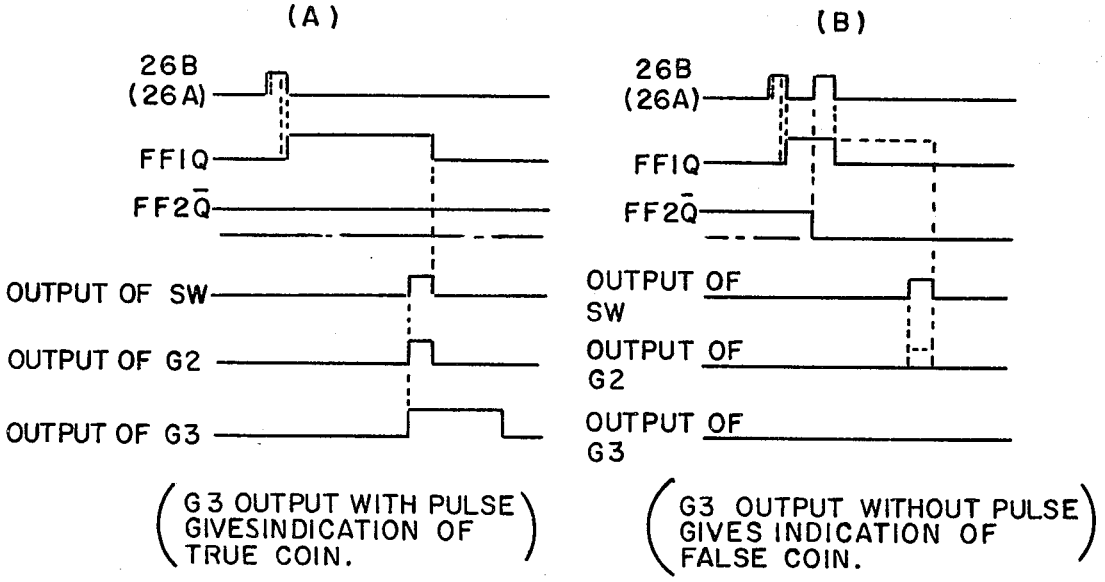
FIGS. 16(A) and 16(B) are waveform diagrams showing the operation of the decision circuit shown in FIG. 15.

FIG. 12 shows an alternative embodiment of the invention. Like elements as described in the previous embodiment, e.g. bridge circuit 7 and rectifying/smoothing circuit 9, are identified by the same numeral as in FIG. 2. Specifically, variable inductor $L_1$ and variable resistor $R_1$ are set in bridge circuit 7 so that the circuit is balanced when coin C passes coin sensor 1. Rectifying/smoothing circuit 9 rectifies and smoothes the output waveform from bridge circuit 7. Voltage divider 23 includes resistors 23A, 23B and 23C such that first reference voltage $V_{r1}$ at output terminal 24 of voltage divider 23 is the same as reference voltage $V_r$ obtained from voltage divider 13 shown in FIG. 2. Resistances 23A and 23B are selected so that second reference voltage $V_{r2}$ at output terminal 25 of voltage divider 23 is slightly greater than first reference voltage $V_{r1}$, as shown in FIGS. 13(A) and 14(A). Output $V_S$ of rectifying/smoothing circuit 9 and reference voltage $V_{r1}$ are supplied to first comparator 26A (FIG. 12), and output $V_S$ and reference voltage $V_{r2}$ are supplied to second comparator 26B. Decision circuit 27 is shown in greater detail in FIG. 15. The outputs of comparators 26A and 26B are supplied to decision subcircuits 27A and 27B, respectively. The outputs of decision subcircuits 27A and 27B are produced as a decision output through AND gate G3. Decision subcircuits 27A and 27B are identical to one another, and only decision subcircuit 27B is illustrated in detail in FIG. 15. The output from comparator 26B is supplied to clock input terminal CL of a JK flip-flop FF1 and also to one input terminal of AND gate G1. Voltages +V and −V are impressed on terminals J and K of the flip-flop FF1, thereby inverting the flip-flop state at the trailing edge of a clock signal inputted to clock input terminal CL. Output Q of flip-flop FF1 is supplied to the other input terminal of AND gate G1. The output from a coin-detecting switch SW, positioned proximate coil 1, is supplied to clear input terminal C of flip-flop FF1 through delay element D1. The output of AND gate G1 is supplied to set terminal S of RS flip-flop FF2. Output Q of flip-flop FF2, output SW and output Q of flip-flop FF1 are supplied to AND gate G2. Monostable multivibrator MV is triggered by a pulse from AND gate G2 to supply an input signal to AND gate G3. When an input signal is supplied to AND gate G3 from both subcircuits 27A and 27B, the output of AND gate G3 is binary "1" indicating that the coin is a specie. When the output from AND gate G3 is binary "0", the coin is a slug. FIGS. 16(A) and 16(B) show signal waveforms of selected elements shown in FIG. 15 when the deposited coin is a specie and a slug, respectively. Waveforms in broken lines represent working states of elements of decision subcircuit 27A, and continuous lines represent working states of elements of decision subcircuit 27B. Only in the case of a specie, as shown in FIG. 16(A), do the outputs of AND gates G2 in both subcircuits 27A and 27B go to binary "1" in response to a pulse from switch SW.

Figure 6:
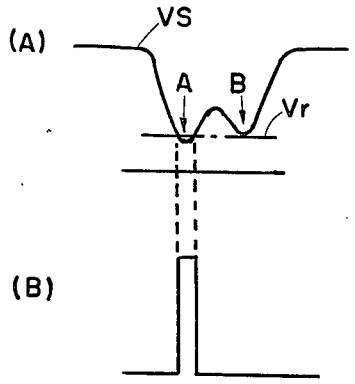
FIG 6 PRIOR ART
FIGS. 6(A) and 6(B) are waveform diagrams showing the outputs of the rectifying/smoothing circuit and the comparator in the case of a third slug.
Figure 7:
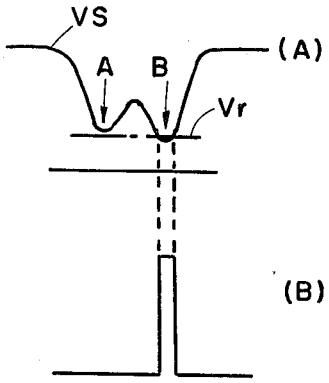
FIG 7 PRIOR ART
FIGS. 7(A) and 7(B) are waveform diagrams showing the outputs of the rectifying/smoothing circuit and the comparator in the case of a fourth slug.

When output $V_S$ of a slug including two troughs, as shown in FIGS. 6 and 7, is inputted to comparators 26A and 26B, the troughs of the waveform become lower than first reference voltage $V_{r1}$ only once, as shown in FIGS. 13(A) and 14(A). Therefore, only one pulse is outputted from first comparator 26A to decision circuit 27, as shown in FIGS. 13(B) and 14(B). However, the troughs of the waveform become lower than second reference voltage $V_{r2}$ twice. Therefore, two pulses are outputted, as shown in FIGS. 13(C) and 14(C), from second comparator 26B to decision circuit 27.

In case one pulse is outputted from first comparator 26A but two pulses are outputted from second comparator 26B, decision circuit 27 determines the deposited coin to be a slug. Decision circuit 27 will determine the deposited coin to be a specie only when the outputs from first comparator 26A and second comparator 26B are both only one pulse. Therefore, a slug will never be determined to be a specie.

The embodiments of the invention in which an exclusive property or privilege is claimed are defined as follows:

1. A coin sorting machine comprising:

a coin passage;

a coin sensor proximate said coin passage;

a bridge circuit means including said coin sensor and establishing an equilibrium only once when a specie passes said coin sensor;

transferring circuit means for transmitting a signal indicating a variation in the output of said bridge circuit means;

standard means for providing first and second predetermined referential values;

checkup circuit means connected to said transferring circuit means and to said standard means to receive the output of said transferring circuit means, said checkup circuit means including first and second checkup elements, said first element comparing said signal with said first referential value and producing a first output pulse when said signal is beyond a first limit defined by said first referential value, said second element comparing said signal with said second referential value and producing a second output pulse when said signal value is beyond a second limit defined by said second referential value; and a sorting output circuit means connected to said checkup circuit means and producing an output indicating that a coin passing said coin sensor is a specie when and only when said first and second checkup elements both produce a single pulse output in response to the passing of the coin.

2. The coin sorting machine as set forth in claim 1, wherein said referential values have the dimension of time;

wherein said machine further comprises means for generating a predetermined reference voltage defining a third limit;

wherein said transferring circuit means includes a comparator which is supplied with said reference voltage and a voltage input proportional to the output of said bridge circuit, said comparator producing said signal in the form of a continuous pulse output for the time period for which the value of said voltage input is beyond said third limit defined by said reference voltage; and wherein said first and second checkup elements compare the duration of said continuous pulse output with said first and second referential values, respectively, to produce said first and second output pulses when said duration is longer than said first and second referential values, respectively.

3. The coin sorting machine as set forth in claim 1, wherein said referential values have the dimension of voltage; and wherein said signal is proportional to the output of said bridge circuit.

* * * * *